United States Patent [19]

Bernhardt

[11] 4,214,506

[45] Jul. 29, 1980

[54] HYDRAULIC CONTROL ARRANGEMENT WITH AT LEAST ONE MULTIPLE POSITION VALVE

[75] Inventor: Wolfgang Bernhardt, Korntal, Fed. Rep. of Germany

[73] Assignee: Robert Bosch GmbH, Stuttgart, Fed. Rep. of Germany

[21] Appl. No.: 959,879

[22] Filed: Nov. 13, 1978

[30] Foreign Application Priority Data

Dec. 23, 1977 [DE] Fed. Rep. of Germany ..... 2757660

[51] Int. Cl.[3] ..... F15B 11/16; F15B 13/04

[52] U.S. Cl. ..... 91/527; 60/484; 60/DIG. 2; 91/449; 91/530

[58] Field of Search ..... 91/508, 525, 527, 530, 91/459; 60/484, DIG. 2, DIG. 10

[56] References Cited

U.S. PATENT DOCUMENTS

| | | | |
|---|---|---|---|
| 2,643,515 | 6/1953 | Harsch | 91/527 X |
| 3,910,045 | 10/1975 | Herrmann | 91/530 |

*Primary Examiner*—Abraham Hershkovitz

*Attorney, Agent, or Firm*—Michael J. Striker

[57] ABSTRACT

A hydraulic control arrangement for hydraulic consumer includes a multiple position valve having a control slide movable by proportional magnets between a neutral position and a plurality of working positions, in which the magnets may be remote controlled from an analog desired value signal and in which a stop valve is provided in a control circuit leading from the consumer to an over-pressure valve, which in turn is connected, upstream of the multiple position valve, parallel to the consumer between a pressure conduit connected to a source of pressure and a return conduit connected to a tank.

10 Claims, 4 Drawing Figures

HYDRAULIC CONTROL ARRANGEMENT WITH AT LEAST ONE MULTIPLE POSITION VALVE

BACKGROUND OF THE INVENTION

Hydraulic control arrangements are known in the art in which a multiple position valve coordinated with a hydraulic consumer controls the magnitude and direction of flow of pressure fluid to and from the hydraulic consumer. In this known control arrangement the pressure fluid is produced by an adjustable pump, the pressure side of which is relievable over a pressure valve to the return conduit of the control arrangement and in which the spring biased side of the valve member of the pressure valve is impingeable over a control conduit with the maximum load pressure in the consumer. The disadvantage of this known control arrangement is that the multiple position valve is not suitable for a proportionate remote control. The known control arrangement has the further disadvantage that pressure fluid may flow over a release conduit with a throttle from the consumer over the control conduit to the tank so that a load acting on the hydraulic consumer cannot be held in the respective position when the valve slide of the multiple position valve is in its neutral position. Furthermore, this known control arrangement with the adjustable pump and the additional pressure limiting valve is relatively expensive.

SUMMARY OF THE INVENTION

It is an object of the present invention to provide a control arrangement for at least one hydraulic consumer which avoids the disadvantages of such control arrangements known in the art.

It is a further object of the present invention to provide a control arrangement of the aforementioned kind in which the multiple position valve may be remotely controlled and in which, regardless of the position of the multiple position valve an undesired movement of the hydraulic consumer connected thereto under the influence of the load acting thereon is positively avoided.

It is an additional object of the present invention to provide a multiple position valve, the positions of which are controlled by proportional magnets and in which the forces of these magnets which control the position of the valve slide of the position valves may be held relatively low and wherein the whole arrangement can be constructed in a compact manner.

With these and other objects in view, which will become apparent as the description proceeds, the hydraulic control arrangement according to the present invention for at least one hydraulic consumer having a pair of consumer conduits mainly comprises a multiple position valve connected with the consumer conduits and having a valve slide movable between a plurality of positions and proportional drive means for controlling the position of the valve slide and therewith the direction and magnitude of pressure fluid flowing through an inlet conduit connected by a pressure conduit to a source of pressure fluid to a respective one of the consumer conduits and from the other of the consumer conduits through an outlet conduit to a tank, an overpressure valve connected upstream of the multiple position valve between the pressure conduit and the return conduit and having a valve member reciprocatable in a valve chamber connected at one end to the pressure conduit so that the pressure fluid of the source acting on one end of the valve member biases the latter to an open position and a spring acting on the other end of the valve member and biasing the latter to a closed position, control conduit means for transmitting the maximum load pressure in a respective one of the consumer conduits to the other end of the valve chamber of the overpressure valve to support the action of the spring, a changeover valve constituted by a pair of one-way valves in the control conduit means for preventing flow of fluid from the one consumer conduit to the other of the consumer conduits, a stop valve movable between an open and a closed position in the control conduit means between the one-way valves and the other end of the valve chamber of the overpressure valve, a throttle connected, on the one hand, to the control conduit means between the stop valve and the other end of the aforementioned valve chamber of the overpressure valve and, on the other hand, to the return conduit, and means controlling the position of the stop valve depending on the position of the valve slide of the multiple position valve.

The proportional drive means preferably comprises a pair of proportional magnets and the stop valves is preferably a solenoid-operated two port two-position valve.

The arrangement includes preferably a plate on which the stop valve and the two one-way valves are arranged and the plate is provided with four bores therethrough forming part of the inlet conduit, the consumer conduits and the return conduit and a check valve is arranged in that bore which forms part of said inlet conduit to permit flow of fluid from the source of pressure fluid to the multiple position valve while preventing such flow in the opposite direction.

The means controlling the position of the stop valve depending on the position of the valve slide of the multiple position valve may comprise signal means in the form of an inductive indicator indicating the position of the valve slide of the multiple position valve. The aforementioned signal means are constructed and arranged to move the stop valve to the open position upon movement of the valve slide of the multiple position valve from a neutral position to either of its working positions arranged to opposite sides of the neutral position.

The arrangement may include also a desired value setting means, an amplifier in circuit with the desired value setting means and the proportional magnets of the multiple position valve, and a control lever movable between a central position and a plurality of working positions to opposite sides of the central position mechanically coupled to said desired value setting means. The stop valve is preferably a solenoid operated valve to which an electric circuit is connected which is interrupted by a normally open switch. The switch is mechanically coupled to the aforementioned control lever to be closed when the control lever is moved from the central to a working position, and the switch when closed energizes the solenoid of the stop valve to move the latter to the open position.

The control arrangement may be provided for a plurality of hydraulic consumers in which case the control arrangement includes for each of the consumers a multiple position valve and a stop valve coordinated with each of the multiple position valves in the manner as mentioned above.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
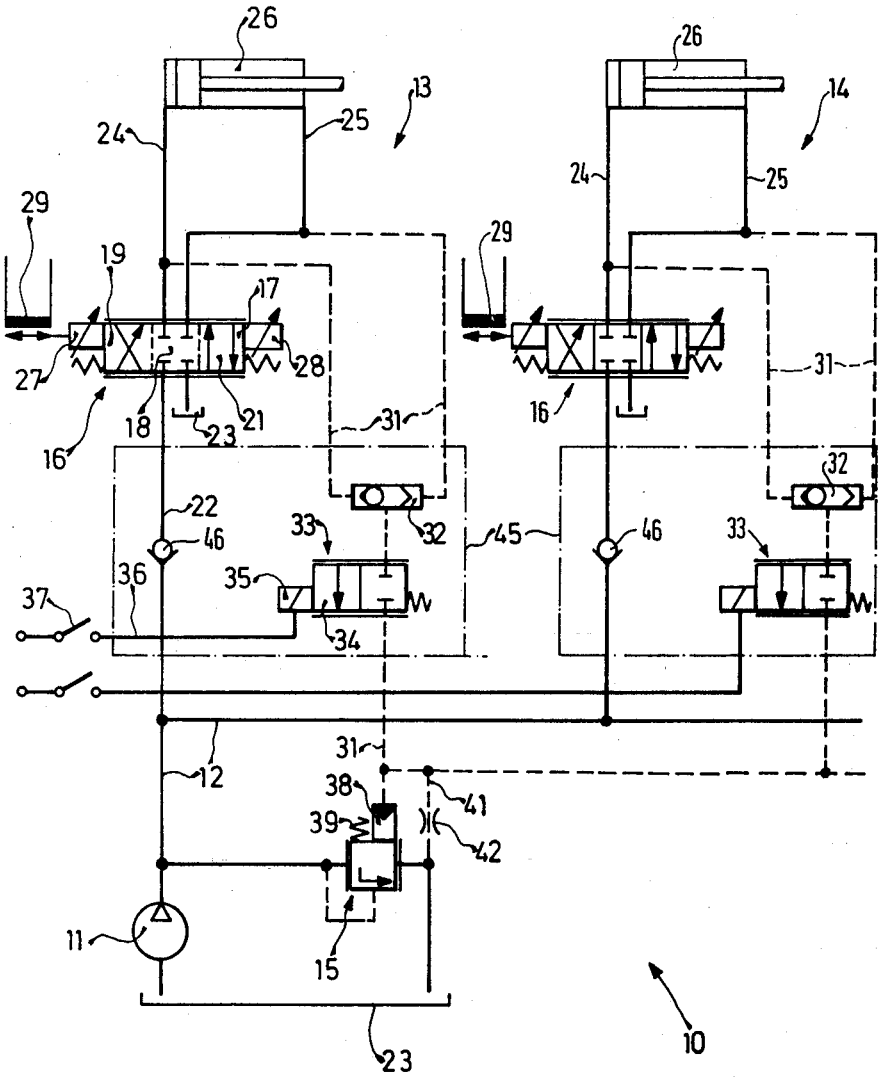
FIG. 1 schematically illustrates a control arrangement according to the present invention.

Referring now to the drawing, and more specifically to FIG. 1, it will be seen that the control arrangement 10 according to the present invention illustrated therein comprises a source of pressure fluid, here shown as a pump 11 adapted to feed a constant volume of pressure fluid from a tank 23 into a pressure conduit 12 to which two consumer circuits 13 and 14 are connected in parallel. An overpressure valve 15 is also connected to the pressure conduit. Since the two consumer circuits 13 and 14 are arranged in the same manner, only the first consumer circuit 13 will be described in the following in further detail.

The first consumer circuit 13 is provided with a four-port three position valve 16 having a valve slide 17 movable from a central neutral position 18, in which flow of pressure fluid to and from the consumer 26 is prevented, to two working positions 19 and 21 to opposite sides of the neutral position in order to control in the usual manner the connection between an inlet conduit 22 connected to the pressure conduit 12, a tank 23 and two consumer conduits 24 and 25 which lead to the double-acting hydraulic consumer 26. The valve slide 17 is held by springs in its central neutral position and movable therefrom to either of its working positions by two proportional magnets 27 and 28 and the valve slide is connected with an inductively acting signal transmitter 29 indicating the position of the valve slide. Control conduits 31 are branched off from the consumer circuits 24 and 25, downstream of the valve 16 and respectively lead to a changeover valve 32 and subsequently thereto over a stop valve 33 to the overpressure valve 15, so that the maximum load pressure acting at any time in the consumer circuits 24 and 25 may be transmitted to the overpressure valve 15. The stop valve 33 is a two port-two position, solenoid operated valve, the valve member 34 of which is normally biased by a spring to its closed position, whereas the solenoid 35, when energized, moves the stop valve to its open position. The solenoid 35 is connected into an electric circuit 36 provided with a switch 37 which, in a known manner, not shown in the drawing, is controlled by the signal transmitter 29. The overpressure valve 15 has a valve member 38 which at one end is loaded by the pressure in the pressure conduit 12 and at its other end is loaded by a spring 39 and the pressure in the control conduit 31, and whereby in addition the spring loaded end of the valve member 38 is connected over a conduit 41, provided with a throttle 42, to the tank 23.

The second consumer circuit 14 is, as mentioned above, connected in parallel to the first consumer circuit 13 trough the pressure conduit 12, and respectively to the over-pressure valve 15.

Figure 2:
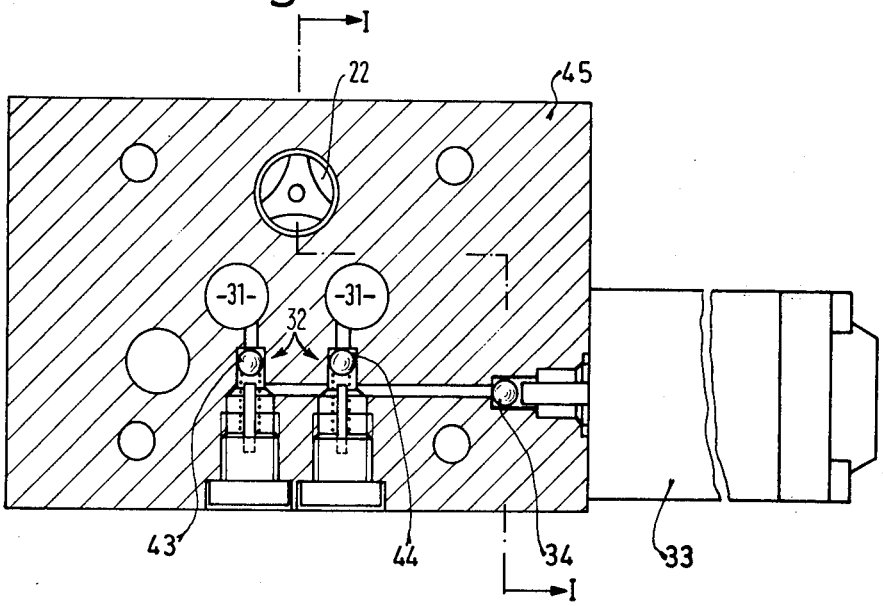
FIG. 2 is a longitudinal cross-section through a plate of the control arrangement according to FIG. 1.
Figure 3:
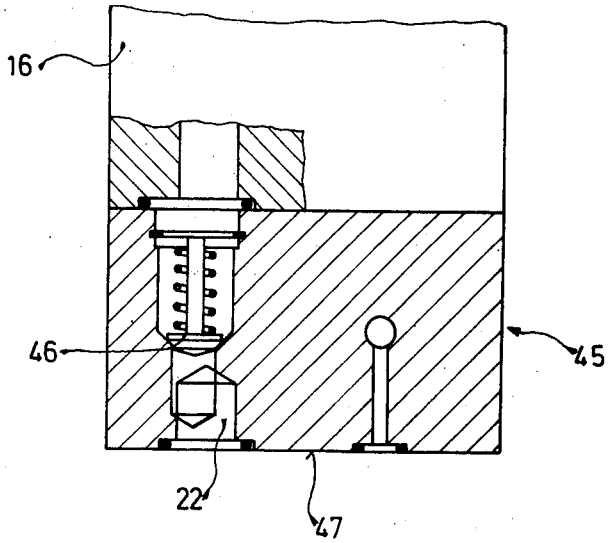
FIG. 3 is a cross-section taken along the line I—I of FIG. 2.

As shown in further detail in FIG. 2, the changeover valve 32, in the form of two one-way valves 43, 44 and the stop valve 33 are arranged in, respectively, on a plate 45 in which four bores forming part of the inlet conduit, the consumer conduits and the return conduit are provided. The two one-way valves 43 and 44 extend preferably from a longitudinal side of the plate 45 into the latter, whereas the stop valve 33 is preferably connected to an end face of the plate 45. As shown in FIG. 3, the multiple position valve 16 is connected to and abutting against the upper face place 45 and an additional one-way valve 46 permitting flow of pressure fluid from the pressure conduit 12 through the inlet conduit 22 to the valve 16, while preventing flow of pressure fluid in the opposite direction, is arranged in the bore of the plate 45 forming part of the inlet conduit 22. By arranging the valve 16 on the upper face of the plate 45, the bottom face 47 of the plate 45 is constructed for connecting the inlet conduit 22, the return conduit to the tank 23, and the control conduit 31. In this way a simple and compact construction is obtained.

The above-described control arrangement will operate as follows:

In the position of the valve slide 17 of the two multiple position valves 16, as shown in FIG. 1, no pressure fluid can pass from the inlet conduits 22 to the consumer conduits 24, 25 nor can pressure fluid pass from the consumers 26 to the tank 23. Since the action of the two consumer circuits 13 and 14 is the same, only the first consumer circuit 13 will be described in the following. The maximum load pressure acting on the hydraulic consumer 26 is transmitted over the control circuit 31 and the change-over valve 32 to the stop valve 33, the valve member 34 of which is, however, held by the spring acting thereon in the closed position and therewith flow of fluid through the control circuit 31 beyond the stop valve 33 is interrupted. The oil pumped by the pump 11 flows over the overpressure valve 15 to the tank 23, whereby the relatively weak spring 39 acting on the valve member 38 of the overpressure valve will assure that the pump 11 has to work only against this low pressure. In the neutral position 18 of the valve slide 17, the signal transmitter 29 does not produce any signal, so that the switch 37 connected to the signal transmitter 29 remains open and the electrical circuit 36 to the solenoid 35 is interrupted.

If now the valve slide 17 of the multiple position valve 16 is moved by means of one of the proportional magnets 27 or 28 of its neutral position to one of its working positions 19 or 21, then the pressure fluid will flow in the usual manner from the pump 11 to the consumer 26 and from the latter to the tank 23. Thereby the magnitude and the direction of the pressure fluid may be controlled. As soon as the valve slide 17 is moved out of its neutral position 18, the signal transmitter 29 produces a signal closing the switch 37 so that the solenoid 35 is energized and the stop valve 33 opened. The maximum pressure acting in the consumer circuits 24 and 25 will be selected by the changeover valve 32 and transmitted over the now open valve 33 and the control circuit 31 to the over-pressure valve 15. This will therefore assure that independent from the load acting at any time on the hydraulic consumer 26, the pressure gradient which determines the flow of oil over the multiple position valve 16 will always be held at the same magnitude, whereby this magnitude will be determined by the spring 39 acting on the overpressure valve 15. Due to the constant, relatively low pressure gradient at the multiple position valve 16, the fluid forces onto the valve slide 17 are also relatively small so that it is possible to actuate the valve slide 17 directly with proportional magnets, constructed to impart to the valve slide only small forces. In addition, the stop valve 33 will prevent in a simple manner flow of pressure fluid from the consumer 26 over the control circuit 31 and the throttle 42 to the tank 23, when the multiple position valve 16 is in its neutral position 18, so that a load acting on the hydraulic consumer 26 may not change the position of the latter in an undesirable manner. In this way it is possible with the control arrangement according to the present invention to use a proportional valve for the control of a hydraulic consumer and thereby to prevent also in a simple manner any undesired change in the load position. In addition, the energy losses are held within very narrow limits if the multiple position valve 16 is not actuated.

During parallel actuation of the two multiple position valves 16 and the two consumer circuits 13 and 14 the highest pressure acting at any time in the consumer conduits will be transmitted to the overpressure valve 15 and correspondingly the pump pressure influenced.

FIGS. 2 and 3 illustrate an especially advantageous construction in which the changeover valve 32 and the stop valve 33 are arranged in a simple and compact manner in a plate 45.

Figure 4:
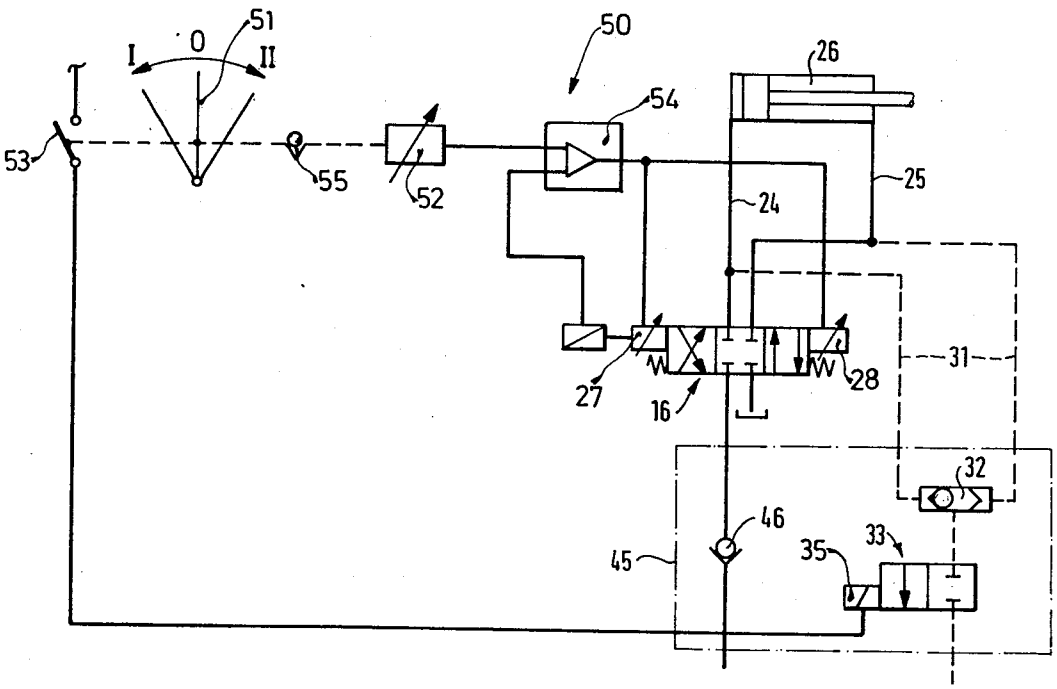
FIG. 4 schematically illustrates part of a modified control arrangement according to the present invention.

FIG. 4 illustrates part of a modified control arrangement 50, in which elements identical with the elements shown in FIG. 1 are provided with identical reference numerals. In the control arrangement 50 shown in FIG. 4 a control lever 51 is mechanically connected with a desired value setting means 52 and a switch 53. The desired value setting means 52 controls over an amplifier 54 the proportional magnets 27 and 28, whereas the switch 53 controls the solenoid 35 of the stop valve 33. A catch 55 releasably holds the control lever 51 in the shown middle portion.

The arrangement of FIG. 4 will operate as follows:

The valve slide 17 of the multiple position valve 16 is moved in a direction and for a distance proportionate to the movement of the control lever 51 from its neutral position. If the control lever 51 is moved in either direction from its neutral position, the switch 53 is closed to actuate thereby the solenoid 35 of the stop valve 33 to move the latter to the open position.

It will be understood that each of the elements described above, or two or more together, may also find a useful application in other types of hydraulic control arrangements for at least one hydraulic consumer differing from the types described above.

While the invention has been illustrated and described as embodied in a hydraulic control arrangement for at least one hydraulic consumer in which a stop valve is provided in a control circuit leading from the consumer to an over-pressure valve which in turn is connected upstream of a multiple position valve controlling the flow of pressure fluid to and from a hydraulic consumer between a pressure conduit connected to a source of pressure fluid and a return conduit connected to a tank, it is not intended to be limited to the details shown, since various modifications and structural changes may be made without departing in any way from the spirit of the present invention.

Thus, for instance, it is possible to operate the multiple position valve not only by proportional magnets, but to provide, for instance, a pneumatic or hydraulic actuation of this valve. However the actuation of the multiple position valve with proportional magnets is the most advantageous and the combination thereof with the stop valve is especially effective.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic control arrangement for at least one hydraulic consumer having a pair of consumer conduits, said hydraulic control arrangement comprising a source of pressure fluid; a tank; a multiple position valve connected to said consumer conduits; an inlet conduit connected by a pressure conduit to said source of pressure fluid and leading to said multiple position valve; an outlet conduit connecting said multiple position valve with said tank, said multiple position valve having a valve slide movable between a plurality of positions and proportional drive means for controlling the positions of said valve slide and therewith the direction and magnitude of flow of pressure fluid from said source to a respective one of said consumer conduits and from the other of said consumer conduits to said tank; an overpressure valve connected upstream of said multiple position valve between said pressure conduit and said return conduit and having a valve member reciprocatable in a valve chamber connected at one end to said pressure conduit so that the fluid pressure of said source acting on one end of said valve member biases the latter to an open position and a spring acting on the other end of said valve member and biasing the latter to a closed position; control conduit means for transmitting the maximum load pressure in a respective one of said consumer conduits to the other end of said valve chamber of said overpressure valve to support the action of said spring; a pair of one-way valves in said control conduit means for preventing flow of fluid from said one consumer conduit to the other of said consumer conduit; a stop valve movable between an open and a closed position in said control conduit means between said one-way valves and said other end of said valve chamber of said overpressure valve; a throttle; a conduit connecting said throttle to said control conduit means between said stop valve and said other end of said valve chamber of said overpressure valve and to said return conduit; and means controlling the position of said stop valve depending on the position of the valve slide of said multiple position valve.

2. A hydraulic control arrangement as defined in claim 1, wherein said proportional drive means comprises a pair of proportional magnets.

3. A hydraulic control arrangement as defined in claim 1, wherein said stop valve is a solenoid operated two port two-position valve.

4. A hydraulic control arrangement as defined in claim 1, and including a plate mounting said stop valve and said two one-way valves.

5. A hydraulic control arrangement as defined in claim 4, wherein said stop valve is arranged on an end face of said plate.

6. A hydraulic control arrangement as defined in claim 4, wherein said plate is provided with four bores therethrough forming part of said inlet conduit, said consumer conduits and said return conduit and including a check valve in that bore which forms part of said inlet conduit and arranged to permit flow of fluid from said source to said multiple position valve while preventing such flow in the opposite direction.

7. A hydraulic control arrangement as defined in claim 1, wherein said means controlling the position of said stop valve depending on the position of said valve slide of said multiple position valve comprises signal means in form of an inductive signal transmitter indicating the position of said valve slide of said multiple position valve.

8. A hydraulic control arrangement as defined in claim 7, wherein said valve slide of said multiple position valve is movable between a neutral position preventing flow of pressure fluid from said source to a respective one of said consumer conduits and outflow of fluid from the other of said consumer conduits to said tank and a pair of working positions to opposite sides of said neutral position, and wherein said signal means is constructed and arranged to move said stop valve to said open position upon movement of said valve slide of said multiple position valve from said neutral position to either of its working positions.

9. A hydraulic control arrangement as defined in claim 1, wherein said control arrangement is provided for a plurality of hydraulic consumers and includes for each of said consumers a multiple position valve and a stop valve coordinated with each of said multiple position valves.

10. A hydraulic control arrangement as defined in claim 2, wherein said stop valve is a solenoid operated valve, and including a desired value setting means, an amplifier in circuit with said desired value setting means and said proportional magnets, a control layer movable between a central position and a plurality of working positions to opposite sides of said central position mechanically coupled to said desired value setting means; an electrical circuit connected to said solenoid of said stop valve; a normally open switch in said circuit and mechanically coupled to said control lever to be closed when said control lever is moved from said central position to a working position, said switch when closed energizing the solenoid of said stop valve to move the latter to the open position.

* * * * *